US008839523B2

(12) United States Patent
Ireland et al.

(10) Patent No.: US 8,839,523 B2
(45) Date of Patent: Sep. 23, 2014

(54) SAFETY KNIFE

(75) Inventors: William Ireland, Churchdown (GB); Peter Jonathan Marshall, Quedgeley (GB)

(73) Assignees: WA1 Designs Limited, Somerset (GB); The Safety Knife Co., Ltd., Gloucestershire (GB)

( * ) Notice: Subject to any disclaimer, the term of this patent is extended or adjusted under 35 U.S.C. 154(b) by 345 days.

(21) Appl. No.: 13/146,984

(22) PCT Filed: Feb. 2, 2010

(86) PCT No.: PCT/GB2010/000177
§ 371 (c)(1), (2), (4) Date: Oct. 3, 2011

(87) PCT Pub. No.: WO2010/089537
PCT Pub. Date: Aug. 12, 2010

(65) Prior Publication Data

US 2012/0017444 A1 Jan. 26, 2012

(30) Foreign Application Priority Data

Feb. 3, 2009 (GB) ..... 0901651.0

(51) Int. Cl.
*B26B 1/08* (2006.01)
*B26B 5/00* (2006.01)

(52) U.S. Cl.
CPC ..... *B26B 5/003* (2013.01)
USPC ..... 30/162; 30/2; 30/164

(58) Field of Classification Search
CPC ..... B26B 1/08; B26B 1/10; B26B 5/00; B26B 5/001; B26B 5/005
USPC ..... 30/162, 335, 2, 163, 164, 329; 7/158
See application file for complete search history.

(56) References Cited

U.S. PATENT DOCUMENTS

2002/0029482 A1 3/2002 Peyrot et al.
2007/0033740 A1 2/2007 Dehner

FOREIGN PATENT DOCUMENTS

EP 1864766 12/2007
GB 2169539 7/1986

OTHER PUBLICATIONS

European Search Report dated Oct. 5, 2010.
International Search Report for PCT/GB2010/000177 dated May 3, 2010.
Search Report for GB1001534.4 dated Apr. 26, 2010.
Search Report for GB1001534.5 dated Apr. 3, 2012.

*Primary Examiner* — Phong Nguyen
(74) *Attorney, Agent, or Firm* — Andrus Intellectual Property Law, LLP

(57) ABSTRACT

A safety knife comprises a knife body (10), a blade carrier (16) movable within the knife body (10) between a retracted position and an extended position, biasing means (24) urging the blade carrier (16) towards its retracted position, latch means to latch the blade carrier (16) in its extended position, and a weight (36) movable along a passage (32) relative to the knife body (10) and engageable with release means (40) to release the latch means.

5 Claims, 3 Drawing Sheets

SAFETY KNIFE

CROSS-REFERENCE TO RELATED APPLICATIONS

This application is the U.S. national stage application of International Application PCT/GB2010/000177, filed Feb. 2, 2010, which international application was published on Aug. 12, 2010, as International Publication WO 2010/089537 in the English language, which is herein incorporated by reference. The International Application claims priority of Great Britain Patent Application 0901651.0, which is herein incorporated by reference.

BACKGROUND OF THE INVENTION

This invention relates to a safety knife intended to reduce the risk of accidents which occur when the blade of a knife is left in an exposed position.

A number of designs of knife are known in which the blade of the knife can be retracted into the knife body when the knife is not in use. In most cases, the retraction of the blade into the knife body requires the user to operate a lever or slide mechanism in order to retract the blade. With such knifes there is a tendency for the blade to be left in its operative, exposed position for extended periods of time even when the knife is not in use. There is an increased risk that a user or passer-by may be injured.

BRIEF SUMMARY OF THE INVENTION

It is an object of the invention to provide a safety knife in which the risk of injury is reduced.

According to the present invention there is provided a safety knife comprising a knife body, a blade carrier movable within the knife body between a retracted position and an extended position, biasing means urging the blade carrier towards its retracted position, latch means to latch the blade carrier in its extended position, and a weight movable along a passage relative to the knife body and engageable with release means to release the latch means.

The weight is conveniently of a carbide material, and is preferably slidable within an elongate passage formed inside the knife body. A spring may be provided at an end of the passage remote from the release means to urge the weight to rebound towards the release means.

The release means conveniently comprises an arm with which the weight is engageable, the arm being connected to a pivotable cam, pivoting movement of which urges the blade carrier out of engagement with the latch means. The arm and cam may be integral with one another. The pivot point of the cam may be chosen to result in the release means operating only when an impact or shock greater than a predetermined level is applied to the knife.

BRIEF DESCRIPTION OF THE SEVERAL VIEWS OF THE DRAWINGS

The invention will further be described, by way of example, with reference to the accompanying drawings, in which.

DETAILED DESCRIPTION OF THE INVENTION

Figure 1:
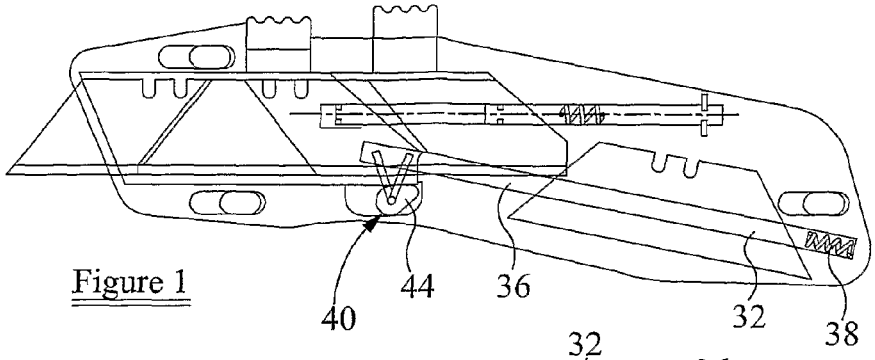
FIG. 1 is a diagrammatic sectional view, illustrating a knife in accordance with an embodiment of the invention.
Figure 2:
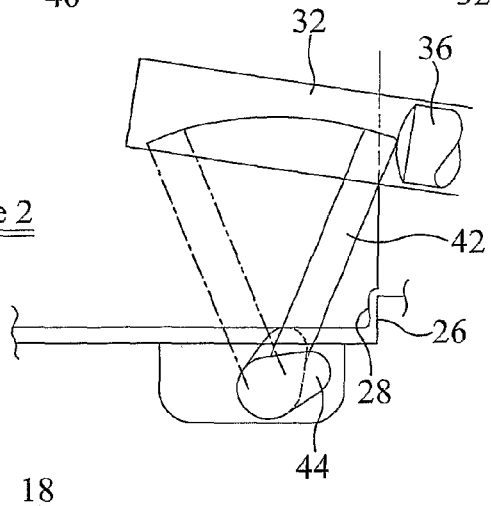
FIG. 2 is an enlarged view illustrating part of the knife.
Figure 3:
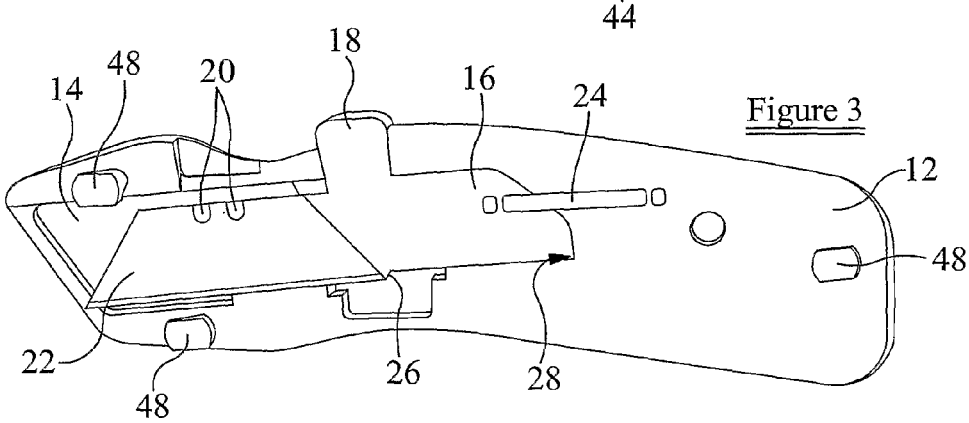
FIGS. 3 and 4 are views illustrating the knife in an open condition.
Figure 4:
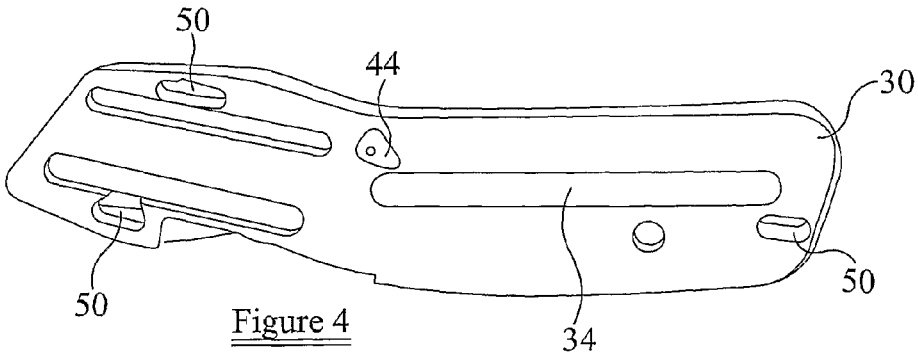

FIGS. 1 to 5 of the accompanying drawings illustrate a safety knife including a knife body 10 of two-part moulded plastics form. The knife body 10 includes a first part 12 which defines a recess 14 within which a blade carrier 16 is slidable. The blade carrier 16 includes an actuator 18 which projects from the knife body 10 and allows a user to drive the blade carrier 16 between a retracted position (as shown in FIG. 3) and an extended position (shown in full lines in FIG. 1). The blade carrier 16 is provided with blade location formations 20 which co-operate, in use, with corresponding features provided on a blade 22 in order to secure the blade 22 to the blade carrier 16. It will be appreciated that with the blade carrier 16 in its retracted position, the blade 22 is housed entirely within the knife body 10, movement of the blade carrier 16 to its extended position resulting in a part of the cutting edge of the blade 22 being exposed from the knife body.

A coiled spring 24 is connected between the blade carrier 16 and the part 12 of the knife body 10, the spring 24 serving to apply a retracting force to the blade carrier 16 urging the blade carrier 16 to the position shown in FIG. 3.

The recess 14 within which the blade carrier 16 is slidable is shaped to define a step 26. When the blade carrier 16 is moved to its extended position, a limited amount of angular movement of the blade carrier 16 is permitted, such movement result in a latching part 28 of the blade carrier 16 latching against the step 26 thereby resisting retraction of the blade carrier 16. The step 26 and latching part 28 together form a latch means for latching the blade carrier 16 against movement. The direction in which the limited angular movement of the blade carrier 16 occurs is in the clockwise direction in the orientation shown in FIG. 3. It will be appreciated that in use of the knife, the application of forces to the blade 22 will also serve to urge the blade carrier 16 in the clockwise direction, thus the use of the knife to cut through a workpiece will not result in the blade carrier 16 being urged away from this position.

The second knife body part 30 includes a passage or channel 32 (see FIG. 1) closed by a cover plate 34 and within which a carbide weight 36 of cylindrical form is slidable. At one end of the passage 32 is conveniently provided a spring 38. At the other end of the passage 32 is provided release means 40. The release means comprises an arm 42 which projects into the passage 32 and with which an end of the weight 36 is engageable as the weight 36 approaches that end of the passage 32. The release means 40 further comprises a cam 44 to which the arm 42 is secured, the cam 44 being positioned adjacent the step 26 when the knife body 10 is assembled with the result that movement of the weight 36 towards the end of the passage 32 can drive the cam 44 for angular movement in the anti-clockwise direction, an end part of the cam 44 abutting the part 28 of the blade carrier 16, moving the blade carrier 16 in an anti-clockwise direction and lifting the part 28 thereof over the step 26. Such movement of the blade carrier results in release of the latch means, thereby allowing the blade carrier 16 to return to its retracted position under the action of the spring 24.

The body half 12 is provided with three locating lugs 48 which, when the knife body 10 is assembled, are received within corresponding openings 50 provided in the other body half 30. A screw-threaded retainer 52 is used to secure the two body halves 12, 30 to one another. However, other techniques for securing these parts to one another are possible.

Figure 5:
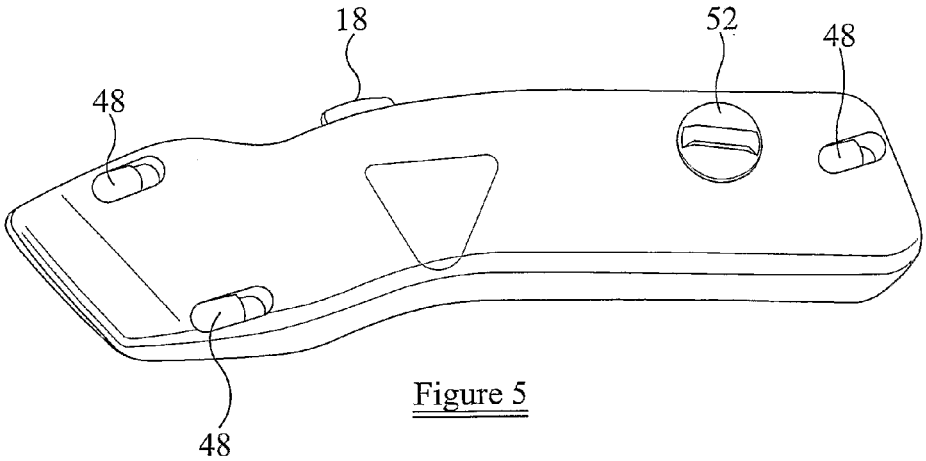
FIG. 5 is a view of the knife in a closed position.

In use, starting from the position shown in FIG. 5 in which the knife is in a retracted condition, if the user wishes to use the knife to cut a workpiece, he moves the blade 22 to an extended position by appropriate manipulation of the actuator 18. This manipulation not only results in extension of the blade 22 such that the cutting edge thereof extends or projects out of the knife body 10, but also, once the part 28 moves past the step 26, results in slight angular movement of the blade carrier 22, latching the blade carrier 22 in its extended position. The knife can then be used as normal. As mentioned hereinbefore, the application of a load to the blade 22 as occurs during a normal cutting action urges the blade carrier 16 in the clockwise direction, thus the risk of the latching means becoming released is minimised. When cutting of the workpiece is completed, the user simply shakes or jolts the knife body 10. This motion results in movement of the weight 36 within the passage 32. If the movement of the weight 36 brings the weight into engagement with the spring 38, then the spring will serve to cause the weight 36 to rebound with minimal loss of energy. Engagement of the weight 36 with the arm 42 results in angular displacement of the cam 44, the displacement of the cam 44 causing the blade carrier 16 to move, angularly, in the anti-clockwise direction and this movement results in the part 28 being lifted over the step 26. As soon as this position is reached, the load applied to the blade carrier 16 by the spring 24 will result in the blade carrier 16 being returned to its retracted position as described hereinbefore. With the blade in the retracted position the risk of injury is minimised.

It will be appreciated that a wide range of motions of the knife body 10 will be sufficient to cause the weight 36 to engage at the arm 42. For example, the movement may be caused by shaking or jolting the knife body 10. Further, if the knife is dropped, the impact of the knife body 10 on a floor or other surface will typically be sufficient to cause the necessary engagement between the weight 36 and arm 42 to cause retraction of the blade 22.

Further, if the blade 22 is impacted in a manner other than that experienced during normal cutting movement, then this may cause anti-clockwise movement of the blade carrier 16 releasing the latch means and thus causing retraction of the blade 22.

Rather than use a cam and arm in the release means, a roller arrangement could be used if desired.

Figure 6:
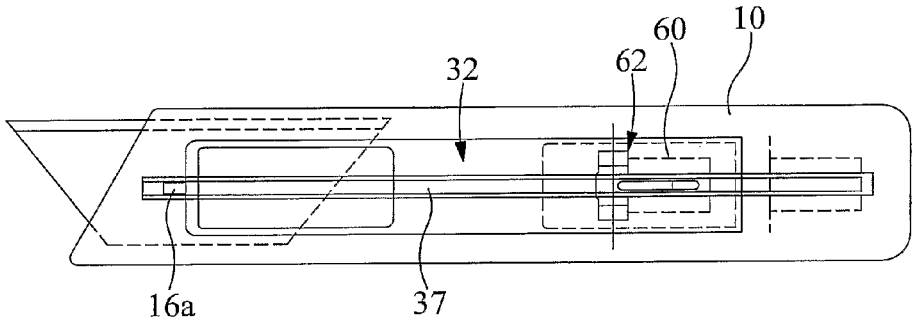
FIGS. 6 and 7 illustrate an alternative design.
Figure 7:
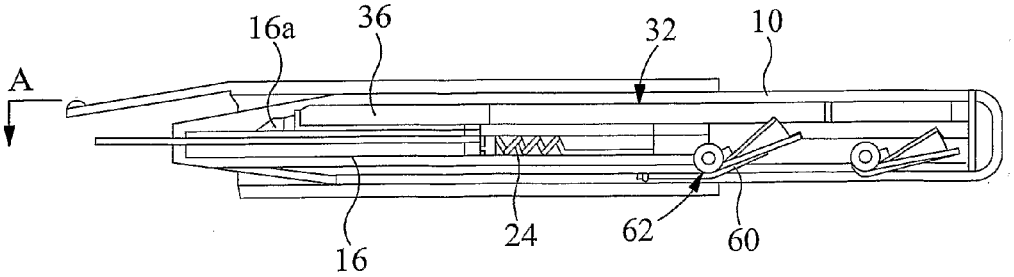

Referring to the FIGS. 6 and 7 there is illustrated an alternative form of knife which in many ways is similar to that of FIGS. 1 to 5. The knife of FIGS. 6 and 7 includes a blade carrier 16 biased by a spring 24 towards a retracted position, the blade carrier 16 being movable to an extended position, in use. Latch means in the form of a latch member 60 is pivotally mounted to the blade carrier 16. The latch member 60 is engageable with a formation provided in the housing 10, when the blade carrier 16 occupies its extended position, to hold the blade carrier 16 in its extended position. A biasing spring 62 is provided to urge the latch member 60 to this position. It will therefore be appreciated that as the blade carrier 16 is moved from its retracted position to its extended position, the latch means will operate automatically to latch the blade carrier 16 in its extended position.

A weight 36 is guided for sliding movement within a longitudinal passage 32 formed in the housing 10. The weight is supported, in this embodiment, for movement along a guide path 37. The weight 36 serves two purposes. Firstly, it is engageable with a projection 16*a* formed on the blade carrier and positioned such that movement of the weight 36 in one direction results in engagement between the weight 36 and the projection 16*a*, continued movement of the weight 36 driving the blade carrier 16 towards its extended position against the action of the spring 24. Once the extended position is reached, the latch means serves to hold the blade carrier 16 in this position as described hereinbefore.

With the blade carrier 16 in the extended position, movement of the weight 36 in the opposite direction results in the weight 36 engaging part of the latch member 60 urging the latch member 60 for movement against the action of the spring 62 to release the latch means and thereby allow return movement of the blade carrier 16 under the action of the spring 24.

It will be appreciated that the arrangement described hereinbefore differs from that of the arrangement of FIGS. 1 to 5 in that movement of the inertial weight serves to both drive the blade carrier 16 to its extended position and also serves to release the latch means and allow return movement of the blade carrier 16.

Although not illustrated, it will be appreciated that a knife is also possible in which the movement of the weight serves just to cause extending movement of the blade carrier 16, return movement being achieved by manual operation of the knife by a user. For example, a latch as in the arrangement of FIGS. 6 and 7 may be provided. Alternatively, a flat spring could be provided instead of a latch member and associated spring. In either case, a button may be provided to disengage the latch and permit return movement of the blade.

In some arrangements, for example that of FIGS. 6 and 7 and the alternative described above, it may be possible to use the combined weight of the blade and associated blade carrier to drive the blade for movement, avoiding the requirement to provide a specific weight.

Figure 8:
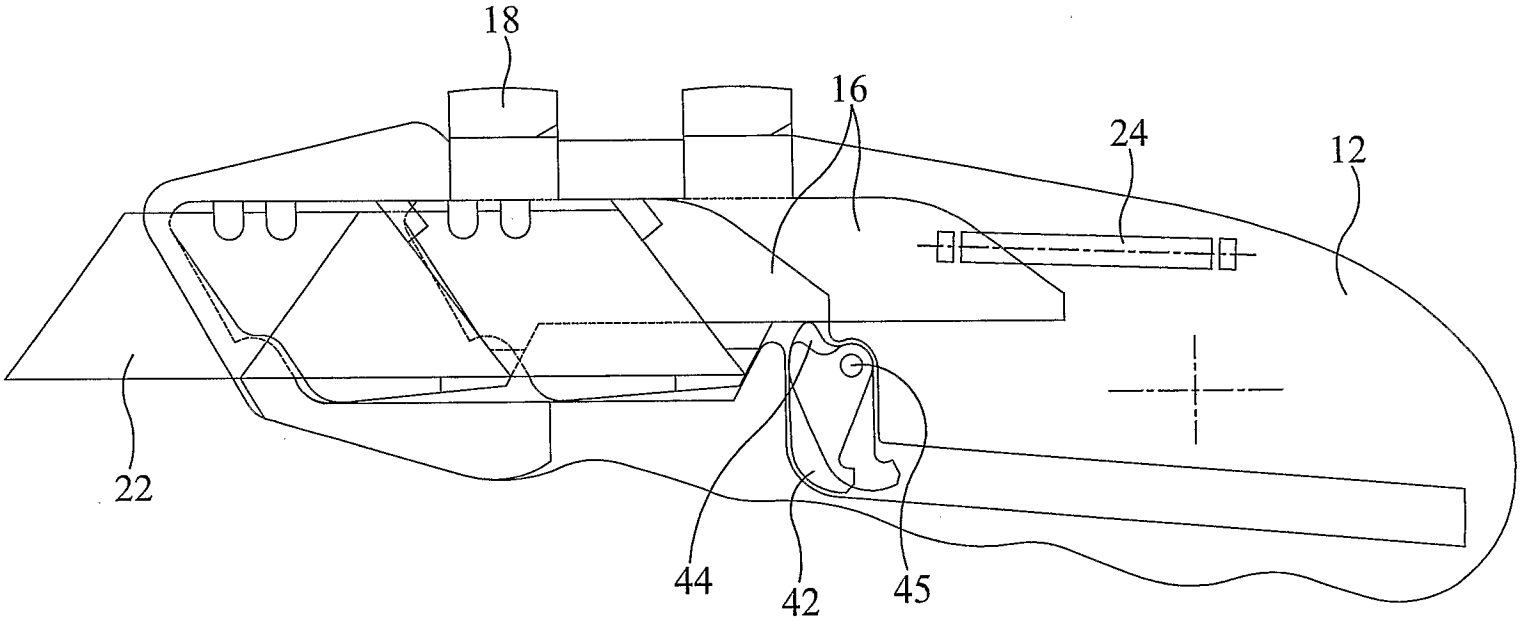
FIG. 8 illustrates a further alternative design.

FIG. 8 illustrates another embodiment, the operation of which is very similar to that of FIGS. 1 to 5. In the arrangement of FIG. 8 the cam 44 and arm 42 are formed integrally with one another and are pivotally mounted by a pivot pin 45. It will be appreciated that the shape of the cam/arm 42 and position of the pivot pin 45 governs the magnitude load that must be applied to the arm 42 by the weight 36 to release the latch means, and the shape/position may be selected according to the intended use of the knife and required release or force. With the exception of these differences, the arrangement of FIG. 8 is similar to and operates in substantially the same manner as outlined hereinbefore.

Although some specific embodiments of the invention are described hereinbefore, it will be appreciated that a wide range of modifications and alterations may be made thereto without departing from the scope of the invention. For example, the knife body 10 may be provided with one or more side guards or depth controls for controlling the depth of cut, further enhancing the safety of the knife even when the blade 22 occupies an exposed position. The side guards or depth controls may be adjustable if desired. One adjustable form of side guard or depth control is illustrated in FIG. 7. It will be appreciated that this arrangement comprises a sleeve to be received upon an end part of the body 10, the sleeve having a side guard or depth control projecting therefrom which lies adjacent a side face of the blade 22 when the blade is exposed. The manner in which the sleeve is secured to the knife body 10 is such that it can be secured in a range of positions. Further, if desired, it may be possible to switch the position of the guard or depth control so as to lie on an opposite side of the blade and thereby adjust the handedness of the knife. Other modifications and alterations are also possible. For example, the invention may be incorporated into, for example, a box cutter type knife or a trimming type knife rather than a utility type knife. Further, the shape of the step 26 and latching part 28 may be modified, for example they could be of ramped form, to change the sensitivity of the knife to jolts or shocks to cause retraction of the blade.

The invention claimed is:

1. A safety knife comprising a knife body, a blade carrier movable within the knife body between a retracted position and an extended position, biasing means urging the blade carrier towards its retracted position, latch means to latch the blade carrier in its extended position, and a weight enclosed within and freely slideable with and movable relative to the knife body along an elongate passage formed inside the knit body and engageable with release means to release the latch means, wherein a spring is provided at an end of the elongate passage remote from the release means, movement of the weight along the elongate passage away from the release means into engagement with the spring causing the weight to rebound towards the release means with minimal loss of energy.

2. A knife according to claim 1, wherein the weight is of a carbide material.

3. A knife according to claim 1, wherein the release means comprises an arm with which the weight is engageable, the arm being connected to a pivotable cam, pivoting movement of which urges the blade carrier out of engagement with the latch means.

4. A knife according to claim 3, wherein the arm and cam are formed integrally with one another.

5. A knife according to claim 1, and adapted to serve as one of a box cutting knife, a trimming knife and a utility knife.

* * * * *